US007350517B2

(12) United States Patent
Perez

(10) Patent No.: US 7,350,517 B2
(45) Date of Patent: Apr. 1, 2008

(54) TILE SAW GUIDE APPARATUS

(76) Inventor: Pedro Perez, 903 N. 14th St., San Jose, CA (US) 95112

( * ) Notice: Subject to any disclaimer, the term of this patent is extended or adjusted under 35 U.S.C. 154(b) by 0 days.

(21) Appl. No.: 11/599,045

(22) Filed: Nov. 14, 2006

(65) Prior Publication Data

US 2007/0125353 A1 Jun. 7, 2007

Related U.S. Application Data

(60) Provisional application No. 60/742,699, filed on Dec. 6, 2005.

(51) Int. Cl.
*B27B 9/04* (2006.01)

(52) U.S. Cl. ..... 125/13.01; 125/13.03; 125/35; 33/42; 33/429; 33/630

(58) Field of Classification Search ..... 125/13.01, 125/13.03, 35; 33/42, 429, 630, 640
See application file for complete search history.

(56) References Cited

U.S. PATENT DOCUMENTS 5,727,325 A * 3/1998 Mussell ..... 33/429
5,813,126 A * 9/1998 Dahl ..... 33/474
6,216,355 B1 * 4/2001 Darnell ..... 33/630
6,604,296 B2 * 8/2003 Mastrobattista ..... 33/640
6,757,981 B2 * 7/2004 Hampton ..... 30/372
2002/0162548 A1 * 11/2002 Lee ..... 125/12

* cited by examiner

*Primary Examiner*—Joseph J. Hail, III
*Assistant Examiner*—Anthony Ojini
(74) *Attorney, Agent, or Firm*—Raymond M. Galasso; Galasso & Associates, LP

(57) ABSTRACT

A tile saw guide apparatus comprising a right-angle triangle shaped guide body and an attachment structure. The right-angle triangle shaped guide body includes a tile receiving space accessible through a first non-hypotenuse edge of the right-angle triangle shaped guide body. A first tile engaging edge defining the tile receiving space extends substantially perpendicular to the first non-hypotenuse edge of the right-angle triangle shaped guide body. A second tile engaging edge defining the tile receiving space extends substantially perpendicular to a second non-hypotenuse edge of the right-angle triangle shaped guide body. The attachment structure is fixedly attached to the right-angle triangle shaped guide body. The attachment structure is configured for fixedly securing the guide body to a table of a tile saw and extends across the hypotenuse edge of the right-angle triangle shaped guide body.

5 Claims, 1 Drawing Sheet

TILE SAW GUIDE APPARATUS

CROSS REFERENCE TO RELATED APPLICATIONS

This patent application claims priority to now abandoned United States Provisional Patent Application having Ser. No. 60/742,699 filed Dec. 6, 2005 entitled "Pit's Square", having a common applicant herewith and being incorporated herein in its entirety by reference.

FIELD OF THE DISCLOSURE

The disclosures made herein relate generally to tiles saws and, more particularly, to tile saw accessories configured for holding tiles.

BACKGROUND

The installation of tile invariably requires cutting of one or more pieces of tile. The quality and accuracy of such pieces of cut tile typically have a direct impact on the resulting quality of installation, ease of installation and/or time required for installation. Regardless of whether the tile is ceramic, marble, granite, vinyl, wood, composite or some other known type of tile requiring cutting with a wet of dry tile saw, precision and repeatability in cuts is a key aspect of achieving a quality and efficient installation. Therefore, a tile saw guide apparatus that is configured for promoting precision and repeatability in cutting tile using a wet or dry tile saw is advantageous, desirable and useful.

SUMMARY OF THE DISCLOSURE

Embodiments of the present invention provides for precision and repeatability in cutting tile using a wet or dry tile saw. More specifically, an apparatus in accordance with the present invention is mountable on a table of a tile saw and, during a series of tile cutting instances, allows tiles to be held in substantially the same prescribed position and location relative to a blade of the tile saw. In doing so, such a tile guide apparatus advantageously allows numerous tiles to be cut in essentially the exact same shape (e.g., non-rectangular) and dimension in a time and money saving manner.

In one embodiment of the present invention, a tile saw guide apparatus comprises a guide body and an attachment structure. The guide body includes a saw table engaging edge, a tile receiving edge and a third edge. The tile receiving edge and the third edge extend generally perpendicular to each other. A tile receiving space is accessible through the tile receiving edge. A first tile engaging edge defining the tile receiving space intersects the tile receiving edge and a second tile engaging edge defining the tile receiving space extends substantially perpendicular to the first tile engaging edge. The attachment structure is configured for fixedly securing the guide body to a table of a tile saw. The attachment structure is fixedly attached to the guide body and extends across the saw table engaging edge.

In another embodiment of the present invention, a tile saw guide apparatus comprising a right-angle triangle shaped guide body and an attachment structure. The right-angle triangle shaped guide body includes a tile receiving space accessible through a first non-hypotenuse edge of the right-angle triangle shaped guide body. A first tile engaging edge defining the tile receiving space extends substantially perpendicular to the first non-hypotenuse edge of the right-angle triangle shaped guide body. A second tile engaging edge defining the tile receiving space extends substantially perpendicular to a second non-hypotenuse edge of the right-angle triangle shaped guide body. The attachment structure is fixedly attached to the right-angle triangle shaped guide body. The attachment structure is configured for fixedly securing the guide body to a table of a tile saw and extends across the hypotenuse edge of the right-angle triangle shaped guide body.

In another embodiment of the present invention, a tile saw guide apparatus comprises a guide body, an attachment structure and measurement indicia. The guide body has a plurality of perimeter edges and a tile receiving space accessible through at least a first one of the perimeter edges. A first tile engaging edge defining the tile receiving space intersects and extends substantially perpendicular to the first one of the perimeter edges. A second tile engaging edge defining the tile receiving space extends substantially perpendicular to the first tile engaging edge. The attachment structure is fixedly attached to the guide body. The attachment structure includes a mounting body and an engagement attached to the mounting body. The mounting body has a saw table receiving groove therein. The engagement member is attached to the mounting body in a manner enabling the engagement member to be selectively adjusted for causing the engagement member and the mounting body to jointly exert a clamping force on a portion of the saw table positioned within the saw table receiving groove. The measurement indicia are provided on the guide body, extending along the first tile engaging edge defining the tile receiving space. The measurement indicia include unit numerals and corresponding spaced-apart gradation lines.

These and other objects, embodiments, advantages and/or distinctions of the present invention will become readily apparent upon further review of the following specification, associated drawings and appended claims.

DETAILED DESCRIPTION OF THE DRAWING FIGURES

Figure 1:
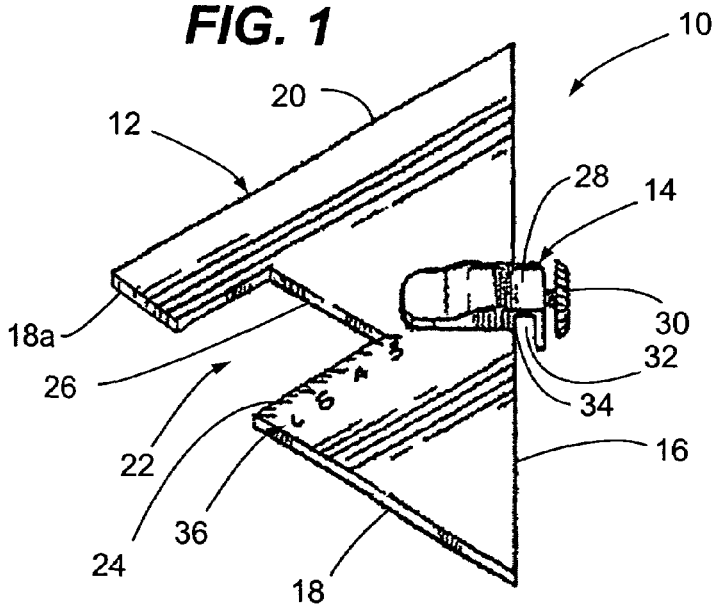
FIG. 1 is a perspective view showing an embodiment of a tile saw guide apparatus in accordance with the present invention.
Figure 2:
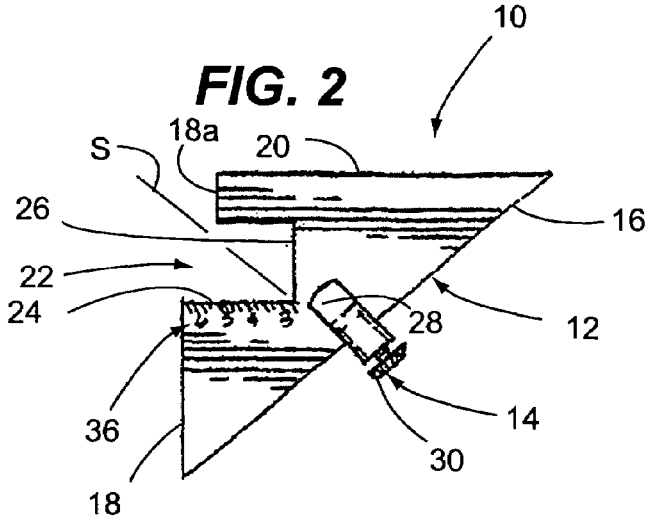
FIG. 2 is a plan view of the tile saw guide apparatus shown in FIG. 1.
Figure 3:
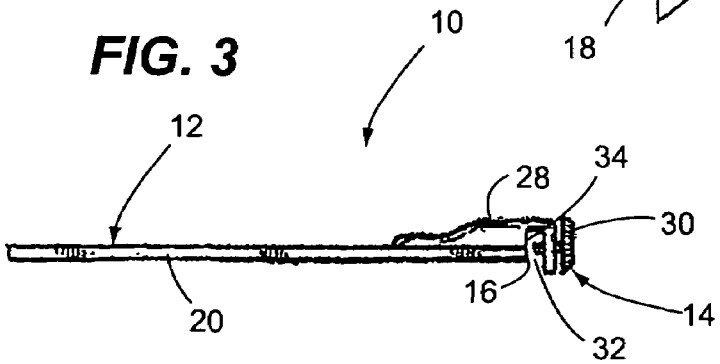
FIG. 3 is a side view of the tile saw guide apparatus shown in FIG. 1.

FIGS. 1-3 show an embodiment of a tile saw guide apparatus in accordance with the present invention, which is referred to herein as the tile saw guide apparatus 10. The tile saw guide apparatus 10 provides for precision and repeatability in cutting tile using a wet or dry tile saw. More specifically, the tile saw guide apparatus 10 is mountable on a table of a tile saw and, during a series of tile cutting instances, allows tiles to be held in substantially the same prescribed position and location relative to a blade of the tile saw. In doing so, the tile saw guide apparatus 10 advantageously allows numerous tiles to be cut in essentially the exact same shape (e.g., non-rectangular) and dimension.

The tile saw guide apparatus 10 includes a guide body 12 and an attachment structure 14. The guide body 12 including a saw table engaging edge 16, a tile receiving edge 18 and a third edge 20, which are each generally straight. The tile receiving edge 18 and the third edge 20 extend generally perpendicular to each other. A tile receiving space 22 is accessible through the tile receiving edge 18. A first tile engaging edge 24 (FIGS. 1 and 2) defining the tile receiving space 22 intersects the tile receiving edge 18. A second tile engaging edge 26 (FIGS. 1 and 2) defining the tile receiving space 22 extends substantially perpendicular to the first tile engaging edge 24.

As shown in FIGS. 1 and 2, preferably, but not necessarily, the first tile engaging edge 24 defining the tile receiving space 22 extends substantially perpendicular to the tile receiving edge 18, and the tile receiving edge 18 and the third edge 20 each intersect the saw table engaging edge 16 whereby the guide body 12 is generally triangular shaped. As shown in FIG. 2, a portion 18*a* of the tile receiving edge 18 that extends between the tile receiving space 22 and the third edge 20 is configured such that an unobstructed saw blade path is provided into the tile receiving space 22 along a straight reference line S extending perpendicular to the saw table engaging edge 16 and through a point of intersection between the first and second tile engaging edges (24, 26) defining the tile receiving space 22. As shown, the portion 18*a* of the tile receiving edge 18 that extends between the tile receiving space 22 and the third edge 20 is offset toward the second tile engaging edge 26 (FIGS. 1 and 2) defining the tile receiving space 22 such that an unobstructed saw blade path is provided into the tile receiving space 22 along the straight reference line S. Alternatively, the portion 18*a* of the tile receiving edge 18 that extends between the tile receiving space 22 and the third edge 20 may be angled such that an unobstructed saw blade path is provided into the tile receiving space 22 along the straight reference line S.

The attachment structure 14 is fixedly attached to the guide body 12. The attachment structure 14 includes a mounting body 28 and an engagement member 30. The mounting body is fixedly attached to the guide body 12 and extends across the saw table engaging edge 16. The mounting body 28 has a saw table receiving groove 32 therein extending substantially parallel to the saw table engaging edge 16 of the guide body 12. The engagement member 30 is threadedly engaged with the mounting body 28 thereby enabling the engagement member to be rotated (i.e., selectively adjusted) for causing the engagement member 30 and the mounting body 28 to jointly exert a clamping force on a portion of a saw table positioned within the saw table receiving groove 32. More specifically, an end of the engagement member 30 is exposed within the saw table receiving groove 32 and forcibly pushes the portion of the saw table positioned within the saw table receiving groove 32 against an opposing engagement face 34 (FIGS. 1 and 3) of the mounting body 28.

Measurement indicia 36 (FIGS. 1 and 2) are provided on the guide body 12. The measurement indicia 36 extend along the first tile engaging edge 24 defining the tile receiving space 22. The measurement indicia 36 include unit numerals (e.g., inches) and corresponding spaced-apart gradation lines (e.g., one-quarter inch increments).

As depicted in FIGS. 1 and 2, the guide body 12 has a right-angle triangle shape. In such an embodiment, the saw table engaging edge 16 is a hypotenuse edge of guide body 12, the tile receiving edge 18 is a first non-hypotenuse edge of the guide body 12 and the third edge 20 is a second non-hypotenuse edge of the guide body 12. It is disclosed herein that a guide body in accordance with the present invention is not necessarily limited to a particular shape. For example, a guide body in accordance with the present invention may have more than three sides.

As depicted in FIGS. 1 and 2, the tile receiving space 22 is accessible only through the tile receiving edge 18. Alternatively, the tile receiving space 22 may intersect both the tile receiving edge 18 and the third edge 20. In such an alternative embodiment, the first tile engaging edge 24 (FIGS. 1 and 2) defining the tile receiving space 22 intersects the tile receiving edge 18 and the second tile engaging edge 26 (FIGS. 1 and 2) defining the tile receiving space 22 intersects the third edge 20.

In use, the tile saw guide apparatus 10 is placed on table of a tile cutting saw with the attachment structure 14 is engaged with a mating structure (e.g., an end rail/ridge) of the table, but not tighten onto the mating structure. A tile is then placed in the tile receiving space 22 and saw guide apparatus is positioned such that the saw blade is aligned at the correct position for cutting the tile at desired angle and dimension. The attachment structure 14 is then engaged with the mating structure (e.g., a end rail) of the table such that the tile saw guide apparatus 10 is fixedly attached to the table. The saw is now used to individually cut tiles into the desired angle and dimension.

Accordingly, a tile saw guide apparatus in accordance with the present invention saves time and money by not having to measure each time that is to be cut to a given angle and dimension. The angular orientation of the tile receiving space determines the nominal angular shape of a cut tile. Thus, a set of apparatuses each having a tile receiving space of different angular orientation with respect to a reference edge (e.g., the saw table engaging edge 16) is provided for enabling various able cuts to be made. Alternatively, a portion of the guide body carrying the tile receiving space may be angularly adjustable with respect to a reference edge of a portion of the guide body defining a reference edge (e.g., rotatably attached thereto).

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A tile saw guide apparatus, comprising:

a right-angle triangle shaped guide body including a tile receiving space accessible through a first non-hypotenuse edge of said right-angle triangle shaped guide body, wherein a first tile engaging edge defining the tile receiving space extends substantially perpendicular to the first non-hypotenuse edge of said right-angle triangle shaped guide body and wherein a second tile engaging edge defining the tile receiving space extends substantially perpendicular to a second non-hypotenuse edge of said right-angle triangle shaped guide body; and an attachment structure fixedly attached to said right-angle triangle shaped guide body, wherein the attachment structure extends across the hypotenuse edge of said right-angle triangle shaped guide body and is configured for fixedly securing the right-angle triangle shaped guide body to a table of a tile saw; and wherein the attachment structure includes:

a mounting body having a saw table receiving groove therein extending substantially parallel to the hypotenuse edge of said right-angle triangle shaped guide body; and an engagement member attached to the mounting body in a manner enabling the engagement member to be selectively adjusted for causing the engagement member and the mounting body to jointly exert a clamping force on a portion of the saw table positioned within the saw table receiving groove.

2. The tile saw guide apparatus of claim 1 wherein a portion of the first non-hypotenuse edge that extends between the tile receiving space and the second non-hypotenuse edge is configured such that an unobstructed saw blade path is provided into the tile receiving space along a straight reference line extending perpendicular to the hypotenuse edge of said right-angle triangle shaped guide body and through a point of intersection between the first and second tile engaging edges defining the tile receiving space.

3. The tile saw guide apparatus of claim 1, further comprising:

measurement indicia provided on the guide body, wherein said measurement indicia extend along the first tile engaging edge defining the tile receiving space.

4. The tile saw guide apparatus of claim 3 wherein a portion of the first non-hypotenuse edge that extends between the tile receiving space and the second non-hypotenuse edge is configured such that an unobstructed saw blade path is provided into the tile receiving space along a straight reference line extending perpendicular to the hypotenuse edge of said right-angle triangle shaped guide body and through a point of intersection between the first and second tile engaging edges defining the tile receiving space.

5. The tile saw guide apparatus of claim 4 wherein the attachment structure includes:

a mounting body having a saw table receiving groove therein extending substantially parallel to the hypotenuse edge of said right-angle triangle shaped guide body; and an engagement member attached to the mounting body in a manner enabling the engagement member to be selectively adjusted for causing the engagement member and the mounting body to jointly exert a clamping force on a portion of the saw table positioned within the saw table receiving groove.

* * * * *